US006933263B2

(12) United States Patent
Manka et al.

(10) Patent No.: US 6,933,263 B2
(45) Date of Patent: Aug. 23, 2005

(54) EMULSIFIED BASED LUBRICANTS

(75) Inventors: John S. Manka, Chardon, OH (US); Matthew R. Sivik, Broadview Hts., OH (US); Richard A. Denis, Auburn Township, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 91 days.

(21) Appl. No.: 10/154,276

(22) Filed: May 23, 2002

(65) Prior Publication Data

US 2003/0220205 A1 Nov. 27, 2003

(51) Int. Cl.[7] ..... C10M 169/06; C10M 173/00

(52) U.S. Cl. ..... 508/154; 508/208; 508/390; 508/421; 508/450; 508/545; 508/583

(58) Field of Search ..... 508/154

(56) References Cited

U.S. PATENT DOCUMENTS

| | | | | | |
|---|---|---|---|---|---|
| 4,070,321 | A | * | 1/1978 | Goretta et al. | 524/801 |
| 4,452,940 | A | * | 6/1984 | Rosen | 524/801 |
| 4,786,679 | A | * | 11/1988 | Wetegrove et al. | 524/827 |
| 4,992,185 | A | * | 2/1991 | Shim | 508/336 |
| 5,256,320 | A | | 10/1993 | Todd et al. | 252/32.007 |
| 5,354,485 | A | | 10/1994 | Tipton et al. | 252/34 |
| 5,362,409 | A | | 11/1994 | Wiggins et al. | 252/32.7 |
| 5,614,482 | A | * | 3/1997 | Baker et al. | 508/496 |
| 5,622,649 | A | * | 4/1997 | Hunter et al. | 516/29 |
| 5,746,945 | A | * | 5/1998 | Ryklin et al. | 516/23 |
| 5,773,073 | A | * | 6/1998 | Matsuda et al. | 800/300 |
| 5,851,961 | A | * | 12/1998 | Magyar | 507/119 |
| 6,063,742 | A | | 5/2000 | Konzman | 508/368 |
| 6,423,326 | B1 | * | 7/2002 | Shapiro | 424/401 |
| 6,691,715 | B2 | * | 2/2004 | Matz et al. | 132/202 |
| 6,824,623 | B1 | | 11/2004 | Gross et al. | 134/36 |

FOREIGN PATENT DOCUMENTS

| | | |
|---|---|---|
| CA | 914144 | 11/1972 |
| EP | 0340323 | 11/1989 |
| GB | 1571652 | 7/1980 |
| GB | 1591652 | 6/1981 |
| WO | WO00/00572 | 1/2000 |

OTHER PUBLICATIONS

"The HLB System, a time–saving guide to emulsifier selection", ICI United States Inc., (1976), pp. 1–20.

* cited by examiner

*Primary Examiner*—Ellen M. McAvoy
(74) *Attorney, Agent, or Firm*—Teresan W. Gilbert; Michael F. Esposito

(57) ABSTRACT

The invention relates to a novel emulsified composition comprising (a) major amount of an aqueous phase, (b) a minor amount of an organic phase and (c) a minor but effective amount of at least one emulsifier to emulsify the aqueous and organic phase resulting in a water in oil emulsified lubricants, in particular an emulsified greases. Further, the present invention provides a process for making the emulsified compositions.

19 Claims, No Drawings

EMULSIFIED BASED LUBRICANTS

TECHNICAL FIELD OF INVENTION

The invention relates to emulsion based lubricants. In particular the invention relates to water in oil emulsion lubricants, in particular lubricants that can be used as greases.

BACKGROUND OF INVENTION

Lubricating compositions are used to reduce friction between surfaces which are moving with respect to each other. The lubricant reduces the amount of intimate contact between the moving surfaces. The lubricant prevents contact between the moving surfaces thus preventing harmful wear to the surfaces. The lubricant generally lowers the coefficient of friction. To be effective, the lubricant, in particular a grease needs sufficient anti-wear, anti-weld and extreme pressure properties to prevent metal to metal contact under high load conditions.

Generally, most lubricants, have been based on petroleum oil although synthetic based oil lubricants have been used for special applications. Grease compositions contain an oil of lubricating viscosity and a thickening agent. Greases usually include various types of thickeners. Thickeners include simple metal soaps, complex metal salt soap and non-soap thickeners, like clays. Greases are typically made by thickening an oil with a thickener and the addition of additives for performance benefits.

Frequently lubricating oils and, greases come into contact with the environment through leakage, excretion of old lubricants during reapplication, general disposal, mechanical removal, water washout, thermal degradation and the like. The release of lubricants and greases pose an environmental concern. The development of grease-like materials which contain a majority of water and natural products will lessen environmental contamination or impact which would result through the use of currently used mineral or synthetic oil-based lubricants and greases. It has been discovered that an emulsified lubricant can be used in the some of the same applications as conventional lubricants and greases and is environmentally friendly, less expensive, less toxic and less flammable.

SUMMARY OF THE INVENTION

The invention relates to novel emulsified lubricants such as greases comprising (a) a major amount of an aqueous phase, (b) a minor amount of an organic phase and (c) a minor but effective amount of at least one emulsifier to emulsify the aqueous and organic phase resulting in a water in oil emulsified lubricant.

More particularly the emulsified lubricant comprises (a) a major amount of water, (b) optionally water soluble additives, (c) optionally alcohols, (d) an oil of lubricating viscosity, (e) at least one emulsifier and (f) optionally oil soluble additives, resulting in a water in oil emulsified lubricant.

The present invention provides a process for making an emulsified lubricant comprising:

A. mixing the following components (a) a major amount of water, (b) a minor amount of oil of lubricating viscosity, (c) at least one emulsifier, (d) optionally, a water soluble additive, (e) optionally, an oil soluble additive, (f) optionally, an alcohol, (g) optionally, a thickener, and (h) combinations thereof;

B. with sufficient shear to form a water in oil emulsion of a lubricant, in particular an emulsified grease.

The emulsified lubricant is a stable water in oil emulsion. The emulsified lubricant can be used as conventional lubricants however, they are environmentally friendly.

DETAILED DESCRIPTION OF THE INVENTION

The present invention relates to emulsified lubricant compositions in particular emulsified greases and a process to make it. The emulsion is a water in oil emulsion i.e., the oil forms the continuous phase while the water forms the discontinuous phase dispersed in the continuous phase. The emulsion has a viscosity in the range of about 200 to about greater than 200,000 cps or $mm^2$/sec measured on a Brookfield Viscometer with a No. 7 spindle at 20 rpm and 25° C. The emulsions can also be of a consistency which allows them to be evaluated on a an penotrometer according to the ASTM D217 procedure. If measured using the ASTM D217 test, emulsions with penetrations greater than 85 can be obtained.

Natural oils include animal oils and plant oils (e.g., castor oil, cottonseed oil, rapeseed oil, soybean oil, lard oil) as well as liquid petroleum oils and solvent-treated or acid-treated mineral lubricating oils of the paraffinic, naphthenic or mixed paraffinic-naphthenic types. Oils of lubricating viscosity derived from coal or shale are also useful base oils. Synthetic lubricating oils include but are not limited to hydrocarbon oils such as polymerized and interpolymerized olefins (e.g., polybutylenes, polypropylenes, propylene-isobutylene copolymers, poly(1-hexenes, poly(1-octenes), poly(1-decenes), and mixtures thereof); alkylbenzenes (e.g., dodecylbenzenes, tetradecylbenzenes, dinonylbenzenes, and di(2-ethylhexyl)-benzenes); polyphenyls (e.g., biphenyls, terphenyls, and alkylated polyphenyls), alkylated diphenyl ethers and alkylated diphenyl sulfides and the derivatives, analogs, and homologs thereof.

Alkylene oxide polymers and interpolymers and derivatives thereof where the terminal hydroxyl groups have been modified by esterification, etherification, or similar reaction constitute another class of known synthetic lubricating oils. These are exemplified by the oils prepared through polymerization of ethylene oxide or propylene oxide, the alkyl and aryl ethers of these polyoxyalkylene polymers (e.g., methylpolyisopropylene glycol ether having an average molecular weight of 1,000 diphenyl ether of polyethylene glycol having a molecular weight of 500–1,000, diethyl ether of polypropylene glycol having a molecular weight of 1,000–1,500) or mono- and polycarboxylic esters thereof, for example, the acetic acid esters, mixed $C_3$–$C_8$ fatty acid esters, or the $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkyl malonic acids, and alkenyl malonic acids) with a variety of alcohols (e.g., butyl alcohol, hexyl alcohol, dodecyl alcohol, 2-ethylhexyl alcohol, ethylene glycol, diethylene glycol monoether, and propylene glycol). Specific examples of these esters include but are not limited to dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include but are not limited to those made from $C_5$ to $C_{12}$ monocarboxylic acids and polyols and polyol ethers such as neopentyl glycol, trimethylolpropane, pentaerythritol, dipentaerythritol, and tripentaerythritol.

Unrefined, refined and rerefined oils (and mixtures of each with each other) of the type disclosed hereinabove can be used in the lubricant compositions of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil. Refined oils are similar to the unrefined oils except that they have been further treated in one or more purification steps to improve one or more properties. Many such purification techniques are known to those of skill in the art such a solvent extraction, acid or base extraction, filtration, percolation, or similar purification techniques. Re-refined oils are obtained by processes similar to those used to obtain refined oils. Such rerefined oils are also known as reclaimed or reprocessed oils and often are additionally processed by techniques directed to removal of spent additives and oil breakdown products.

Petroleum, synthetic and natural waxes and mixtures of the type disclosed hereinabove can be used in the lubricant compositions of the present invention. Petroleum waxes are paraffinic compounds isolated from crude oil via some refining process. Examples of petroleum waxes are slack wax and paraffin wax. Synthetic waxes are waxes derived from petrochemicals, such as ethylene or propylene. Synthetic waxes include polyethylene, polypropylene, and ethylene-propylene co-polymers. Natural waxes are waxes produced by plants and/or animals or insects. These waxes include bees wax, soy wax and carnauba wax.

The emulsified composition contains oil in the range from about 1% to about 95%, preferably from about 5% to about 40% and more preferably from about 8% to about 20% by weight of the emulsified composition.

The major amount of the emulsified composition is water. The water may be taken from any source. The water includes but is not limited to tap, deionized, demineralized, purified and the like. Combinations of different sources of water may be used. The water is present in the range of about 99% to about 5%, preferably 95% to about 60% and more preferably about 92% to about 80% of the emulsified composition.

Conventional thickeners that are either water soluble, oil soluble, or combinations thereof may optionally be used in the preparation of the emulsified composition. Thickeners for the emulsified composition are generally known in the art.

The oil phase thickeners include but are not limited to alkali and alkaline earth metal soaps of fatty acids and fatty materials, the metals are typified by sodium, lithium, calcium and barium, and examples of fatty materials include stearic acid, hydroxystearic acid, stearin, oleic acid, palmitic acid, myristic acid, cottonseed oil acids, and hydrogenated fish oils. Other thickeners include but are not limited to salt and salt-soap complexes, such as calcium stearate-acetate, barium stearate-acetate, calcium stearate-caprylate-acetate complexes, calcium salts and soaps of low-intermediate- and high-molecular weight acids and of nut oil acids, aluminum stearate, and aluminum complex thickeners. Useful thickeners include, but are not limited to, hydrophilic clays which are treated with an ammonium compound to render them hydrophobic. Typical ammonium compounds are tetraalkyl ammonium chlorides. These clays are generally crystalline complex silicates. These clays include bentonite, attapulgite, hectorite, illite, saponite, sepiolite, biotite, vermiculite, zeolite clays and the like. Combinations of the thickeners may be used.

The water phase includes water soluble additives that include but are not limited to alcohols; water soluble EP antiwear additives; water soluble additives such as dihydrogen butyl phosphate, water soluble phosphate salts, water soluble dithiophosphate salts; water soluble inorganic salts which may give added EP antiwear protection such as xanthates, dithiocarbonates, trithiocarbonates, sulfates, sulfites, sulfides, for example sodium sulfide and the like; water soluble phosphate esters, phosphites, phosphonates, and the like; water soluble dithiophosphate esters; water soluble rust inhibitor such as but not limited to amines like morpholine and alkanolamines, phosphorous and phosphoric acid derivatives such as mono and diesters and amine or metallic salts of phosphoric and phosphorous acid and combinations thereof.

The water soluble additives are added to enhance the performance of the emulsified lubricant. The water soluble additives are preferably present in the range of about 0% to about 50%, preferably about 0.1% to about 30% and more preferably about 1% to about 20% by weight of the emulsified composition.

The water phase thickeners include but are not limited to surfactant gels which are two or more surfactants that associate with each other to form a gel. An example of a surfactant gel surfactant combination is lauryl sulfobetaine and cationic surfactants. The water phase thickeners further include but are not limited to water-soluble polymeric thickeners. Generally, these thickening agents can be polysaccharides, synthetic thickening polymers, or mixtures of two or more of these. Among the polysaccharides that are useful are natural gums such as those disclosed in "Industrial Gums" by Whistler and B. Miller, published by Academic Press, 1959. Examples include but are not limited to gums are gum agar, guar gum, gum arabic, algin, dextrans, xanthan gum and the like.

Also among the polysaccharides that are useful as thickeners are cellulose ethers and esters, particularly the hydroxy hydrocarbyl cellulose and hydrocarbylhydroxy cellulose and its salts. Examples include but are not limited to are hydroxethyl cellulose and the sodium salt of carboxymethyl cellulose. Mixtures of two or more of any such thickeners are also useful.

The water phase thickeners can also be synthetic thickening polymers. Many such polymers are known to those of skill in the art. Representative of them include but are not limited to polyacrylates, polyacrylamides, hydrolyzed vinyl esters, water-soluble homo- and inter-polymers of acrylamidoalkane sulfonates containing 50 mole per cent at least of acryloamido alkane sulfonate and other comonomers such as acrylonitrile, styrene and the like. Poly-n-vinyl pyrrolidones and homo- and copolymers as well as water-soluble salts of styrene-maleic anhydride copolymers and isobutylene-maleic anhydride copolymers can also be used as thickening agents.

The water phase thickeners may also be mineral-based. Many mineral based thickeners are known. Examples include hydrated silica and hydrated magnesium aluminum silicates.

The thickener is employed in an amount from about 0% to about 10%, preferably from 0.2% to about 7% and more preferably about 0.3% to about 5% by weight of the emulsified composition.

The emulsified composition may contain oil soluble additives in the oil continuous phase that are conventionally employed in lubricants. The oil soluble additives include but are not limited to extreme pressure (EP) anti-wear additives, metal deactivators, dispersants, antifoams, corrosion rust inhibitors, antioxidants, detergents, polymers and functionalized polymers and others useful additives for providing enhanced performance characteristics of the emulsified composition and are known in the art. The amount of the organic soluble additive depends on the specific performance characteristics designed for the emulsified composition and is generally in the range of about 0% to about 75%, preferably from about 0.5% to about 60% and more preferably from about 1% to about 20% of the emulsified composition.

Extreme pressure anti-wear additives that are soluble in the oil include but are not limited to a sulfur or chlorosulphur EP agent, a chlorinated hydrocarbon EP agent, or a phosphorus EP agent, or mixtures thereof. Examples of such EP agents are chlorinated wax, organic sulfides and polysulfides, such as benzyldisulfide, bis-(chlorobenzyl) disulfide, dubutyl tetrasulfide, sulfurized sperm oil, sulfurized vegetable and or animal oils, sulfurized methyl ester of oleic acid, sulfurized alkylphenol, sulfurized dipentene, sulfurized terpene, and sulfurized Diels-Alder adducts; phosphosulfurized hydrocarbons, such as the reaction product of phosphorus sulfide with turpentine or methyl oleate, phosphorus esters such as the dihydrocarbon and trihydrocarbon phosphites, i.e., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite, metal thiocarbamates, such as zinc dioctyldithiocarbamate and barium heptylphenol diacid, such as zinc dicyclohexyl phosphorodithioate and the zinc salts of a phosphorodithioic acid. Additionally, dithiophosphosphate and dithiocarbamate esters and disulfides, and mixtures of mono- and dialkylphosphates salted with alkyl amines may also be used. Combinations of the above may be used. The oil soluble EP agents is present in the range of about 0% to about 12%, preferably from about 0.5% to about 10% and more preferably from about 1% to about 6% by weight of the emulsified composition.

Solid additives in a particle or finely divided form may also be used at levels of 0% to 20%. These include but are not limited to graphite, molybdenum disulfide, zinc oxide, boron nitride, polytetrafluoroethylene, and the like. Mixtures of solid additives maybe used.

Oil soluble polymers and functionalized polymers include but are not limited to polyisobutenes, polymethyacrylate acid esters, polyacrylate acid esters, diene polymers, polyalkyl styrenes, alkenyl aryl conjugated diene copolymers, polyolefins and multifunctional viscosity improvers, including dispersent viscosity modifiers (which impart both dispersancy and viscosity improvement). The polymers may also be used to provide tackiness to the emulsified lubricant. Combinations may be used.

The oil soluble polymers including functionalized polymers are present in the range of about 0% to about 50%, preferably, about 0.01% to about 25%, and more preferably about 0.02% to about 18% by weight of emulsified composition.

The antioxidants that are oil soluble are known in the art and include but are not limited to phenate sulfides, phosphosulfurized terpenes, sulfurized esters, aromatic amines, and hindered phenols. Another example of an antioxidant is a hindered, ester-substituted phenol, which can be prepared by heating a 2,6-dialkylphenol with an acrylate ester under base catalysis conditions, such as aqueous KOH. Combinations may be used. The antioxidants are present in the range of about 0% to about 10%, preferably about 0.25% to 6%, and more preferably about 0.5% to about 3% by weight of the emulsified composition.

Metal deactivators useful in lubricating oil compositions are known in the art and include but are not limited to benzotriazole, benzimidazole, 2-alkyldithiobenzimidazoles, 2-alkyldithiobenzothiazoles, 2-(N,N-dialkyldithiocarbamoyl)benzothiazoles, 2,5-bis(alkyldithio)-1,3,4-thiadiazoles, and 2,5-bis(N,N-dialkyldithiocarbamoyl)-1,3,4-thiadiazoles. Combinations may be used. The metal deactivators are present in the range of 0% to about 5% preferably about 0.1% to about 4% and more preferably about 0.2% to about 3% by weight of the emulsified composition.

Oil soluble detergents are known in the art and include but are not limited to overbased materials prepared by reacting an acidic material (typically an inorganic acid or lower carboxylic acid, preferably carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter. The acidic organic compounds useful in making overbased compositions in general can include carboxylic acids, sulfonic acids, phosphorus-containing acids, phenols or mixtures of two or more thereof.

The metal compounds useful in making the basic metal salts are generally any Group I or Group II metal compounds (CAS version of the Periodic Table of the Elements). The Group I metals of the metal compound include alkali metals (group IA: sodium, potassium, lithium, etc.) as well as Group IB metals such as copper. The Group I metals are preferably sodium, potassium, lithium and copper, more preferably sodium or potassium, and more preferably sodium. The Group II metals of the metal base include the alkaline earth metals (group IIA: magnesium, calcium, barium, etc.) as well as the Group IIB metals such as zinc or cadmium. Preferably the Group II metals are magnesium, calcium, or zinc, preferably magnesium or calcium, more preferably calcium. Generally the metal compounds are delivered as metal salts. The anionic portion of the salt can be hydroxyl, oxide, carbonate, borate, nitrate, etc.

While overbased metal salts can be prepared by combining an appropriate amount of metal base and carboxylic acid substrate, the formation of useful overbased compositions is facilitated by the presence of an additional acidic material. The acidic material can be a liquid such as formic acid, acetic acid, nitric acid, sulfuric acid, etc.

A promoter is a chemical employed to facilitate the incorporation of metal into the basic metal compositions. The promoters are quite diverse and are well known in the art, as evidenced by the cited patents. These include but are not limited to the alcoholic and phenolic promoters. The alcoholic promoters include the alkanols of one to about twelve carbon atoms such as methanol, ethanol, amyl alcohol, octanol, isopropanol, and mixtures of these and the like. Phenolic promoters include a variety of hydroxy-substituted benzenes and naphthalenes. Mixtures of various promoters are sometimes used. The promoters are found in U.S. Pat. Nos. 2,777,874 and 2,616,904.

Combinations of detergents may be used. The detergents are present in the range of about 0% to about 8%, preferably, about 0.1% to about 6%, and more preferably about 0.3% to about 5% by weight of emulsified composition.

Antifoams are known in the art and include but are not limited to organic silicones such as dimethyl silicone and the like. Combinations may be used. The antifoams are present in the range of about 0% to about 2%, preferably about 0.01% to about 1%, and more preferably 0.02% to about 0.7% by weight of the emulsified composition.

Antirust compounds are known in the art and include but are not limited to alkyl substituted aliphatic dicarboxylic acids such as alkenyl and succinic acids, sulfonates relating to the metal detergent, sodium nitrite, calcium salts of oxidized paraffin wax, magnesium salts of oxidized paraffin wax, alkali metal salts, alkaline earth metal salts or amine salts of beef tallow fatty acids, alkenyl succinates or alkenyl succinic acid half esters (whose alkenyl moiety has a molecular weight of about 100 to 300), glycerol monoesters, nonylphenyl ethoxylate, lanolin fatty acid esters, and calcium salts of lanolin fatty acids. Combinations may be used. The antirust compounds are present in the range of about 0% to about 10%, preferably about 0.1% to about 8%, and more preferably 0.2% to about 6% by weight of the emulsified composition.

The emulsified composition contains at least one emulsifier. The emulsifier must be capable of producing a water in oil emulsion to form the emulsified composition. Examples of suitable emulsifiers include but are not limited to alkylaryl sulfonate, lignosulfonate salts, starches and the like. Low hydrophilic lipophilic (sometimes called lyophillic) balance (HLB) surfactants are employed within a range of less than or equal to HLB 9.0, preferably HLB of 0 to 7, and more preferably with an HLB in the range of 4 to 6. Surfactants with HLBs higher than 9 can be used provided they are combined with lower HLB surfactants to give a composite emulsifier system with an HLB in the range that produces water in oil emulsions. The procedures to do this are generally known in the art.

The surfactants include but are not limited to anionic, cationic and non ionic surfactants. Further, the surfactants include but are not limited to (polyisobutenyl) dihydro-2,5-furandione with stearic acid and polyethylenepolyamines, (polyisobutenyl) dihydro-2,5-furandione, cyclic diamines, ethylenamines, pentaerythritol, 4-polybutenyl(C=20–2000)-2-aminophenol, maleinated polyisobutenyl succinic acid amine salts, polyolefin aminoester/salt, polyisobutenylsuccinic anhydride product with diethylethanolamine, polyisobutenylsuccinic anhydride, product with polyethyleneamines and boric acid, polyolefin amide alkeneamine, polyolefin aminoester, polyisobutenylsuccinic anhydride, product with polyethylenepolyamines and carbon disulfide, (polyisobutenyl) dihydro-2,5-furandione esters with pentaerythritol, (polyisobutenyl) dihydro-2,5-furandione pentaerythritol and polyethylenepolyamines, polyisobutenylsuccinic anhydride product with diethylethanolamine, polyisobutenylsuccinic anhydride, product with polyethylene-polyamines pibsa amines, polyisobutenyl glyoxylate amines, sorbitan mono oleate, sorbitan mono isosterate and sorbitan sesquioleate, and the like. Combinations of emulsifiers may be used and are often preferred since it is known by those skilled in the art that combining different emulsifiers often yields more stable emulsions than single emulsifier systems.

The emulsifier may also be selected from hydroxysubstituted hydrocarbon amines (particularly mono-, di-, and tri-alkanol amines wherein each alkanol group contains 2 to about 10 carbon atoms); hydrocarbyl amines (including mono-, di-, and tri-hydrocarbon amines wherein each hydrocarbon group has 1 to about 20 carbon atoms); polyols of 3 to 8 hydroxyls (including those having 3 to 8 hydroxyl groups and 3 to 12 aliphatic carbon atoms and analogous materials made by treating such polyols with alkylene oxides of 2 to 8 carbon atoms); alkylene glycols (including those wherein the alkylene group has 2 to 4 carbon atoms); polyalkylene glycols (including those wherein each alkylene group is of 2 to 4 carbon atoms and the polyalkylene glycol has molecular weights ranging from 50 to about 1500) and sulfonated materials such as sulfonated hydrocarbon and amine-neutralized salts thereof. Among the sulfonated materials are included the sulfonamidcarboxylic acids and neutralized derivatives thereof.

Other emulsifiers include, but are not limited to di- and tri-ethanol and propanol amine, polypropylene glycols, particularly those having an average molecular weight of about 700 to about 1200 and solubility of at least about 20 grams per liter in water at 20° C., glycerin, liquid sugar alcohols, alkali and alkaline earth metal, dodecylbenzene sulfonates, alkali metal laurylsulfonates, and the like. Many other such dispersing agents are known to those of skill in the art. See, for example, the list beginning at page 52 entitled "Coupling Agents" in "McCutcheon's Publications—Combined Edition, Book III—Functional Materials," published by the McCutcheon's Division, M.C. Publishing Co., Ridgwood, N.J., U.S.A., 1976.

The emulsifier is present in the range of about 20% to about 0.25%, preferably about 5% to about 1% and more preferably about 2% to about 1.5% by weight of the emulsified composition.

Optionally, an alcohol may be employed in the emulsified composition. Typical alcohols include but are not limited to polyol-, ethylene glycol, propylene glycol, methanol, ethanol, glycerols and mixtures thereof. The alcohol may be present in the range of about 0% to about 30% preferably about 1% to about 20%, and more preferably about 2% to about 10% by weight of the emulsified composition.

In the practice of the present invention the process to make the emulsified composition is carried out as a batch; semi-batch, continuous process, or a combination. The emulsified composition formed is a stable macro emulsion in which the water components are suspended in a continuous phase of oil components. The emulsified composition can be used first made in a concentrated form and then diluted either immediately or later which ever is more suitable for efficient delivery of the product.

In the practice of the present invention the process is capable of monitoring or adjusting the amount of the oil, the oil soluble additives, water, emulsifier, alcohol and/or water soluble additives to form a stable emulsion with the desired water droplet size. The batch processes described herein depicts one embodiment of the invention. The components are all added to a vessel and mixed or in the alternative the oil soluble components are mixed separately from the separately mixed water soluble components and then both mixtures are added together and emulsified. The components may be introduced into the vessel as discreet components or combinations of the discreet components.

The mixture is emulsified using an emulsification device in the vessel, alternatively the mixture flows from the vessel via a circular line to an emulsification device which is external to the vessel, for about one to about 20 tank turnovers. The temperature of the process is in the range of about 0° C. to about 200° C., preferably in the range of about 8° C. to about 150° C. and most preferably about 15° C. to about 90° C., and a pressure in the range of about atmosphere pressure to about 300 psi, preferably about atmosphere pressure to about 75 psi and more preferably in the range of about atmospheric pressure to about 50 psi resulting in a stable emulsified composition.

In another embodiment a continuous process is used to make the emulsified composition. The feeds of the oil, the emulsifier, the oil soluble additives, the water, the alcohol and the water soluble additives are introduced as discreet feeds or in the alternative as combinations of the discreet feeds, depending on the components solubility, to form a stable emulsified composition. More than one emulsification device may be employed. The continuous process generally occurs under ambient conditions and at a pressure in the range of atmospheric pressure to about 20,000 psi, preferably atmospheric pressure to about 5000 psi, and more preferably about atmospheric pressure to about 4000 psi and with a temperature in the range of 0° C. to about 200° C., preferably about 5° C. to about 150° C. and more preferably from about 10° C. to 100° C.

The emulsification occurs by methods known in the art including but not limited to mixing, mechanical mixture agitation, static mixers, shear mixers, sonic mixers, high pressure mixture, jet mixers, homogenizers, pin mills, rotor-stator mills, microfluidizers and the like.

A programmable logical controller is optionally employed for governing the flow of components in the batch, semi-batch or continuous process, thereby controlling the flow rates and mixing ratio in accordance with the desired blending rates.

The emulsification provides for the desired particles size and a uniform dispersion of the water in the oil. The emulsification results in a uniform dispersion of an emulsified composition having a mean particle droplet size in the range of 0.01 micron to about 20 micron, in another embodiment in the range of about 0.5 micron to about 10 micron, and in another embodiment of the range of about 1 micron to about 5 micron.

The emulsified composition is used as an emulsifier lubricant and more particularly an emulsifier grease. The emulsified composition has a major portion of water and natural products compared to conventional lubricants and is less harmful to the environment. Further, the emulsified grease is used for the same or similar application as are conventional greases.

Specific Embodiment

The following examples demonstrate the process to produce an emulsified lubricant of the invention.

EXAMPLE 1

A 3-speed Hobart mixture was used as the reaction vessel for emulsifying the grease. An 8-qt mixing bowl was charged with about 285 g of soybean oil, about 150 g of a multifunctional performance additive package containing a zinc dialkyldithiophosphate an olefin polysulfide, an amine corrosion inhibitor, a triazole metal deactivator, soybean oil, an antiwear agent composed of a complex mixture of mono and diesters of phosphoric acid, C12–14 alkylamine salt and 15% by weight diluent oil, about 30 g of an olefin sulfide containing about 40% sulfur, about 60 g of a surfactant system comprised of a mixture of polyisobutenylsuccinyl aminoester and polyisobutenylsuccinic acid dimethyl ethanolamine salt and 45% diluent oil, and about 82.5 g of 2000 number average molecular weight polyisobutylene. The components were heated to about 75–85° C. while stirring the mixture with a hip stirrer at the mixer's fastest setting. A solution of 450 g of glycerol and about 1950 g of water was heated to about 65° C.

The water solution was added dropwise to the mixing bowl in 4 increments during which the mixture was constantly heated. The first 600 ml solution was added over a period of 30 min. The second 600 ml solution was added over the next 35 min, the third 600 ml solution was added over the next 20 min and the last addition was added over the next 25 min. The final temperature of the emulsion was about 57° C. The final milky white emulsion was weighed and was found to be 640 g. The product was collected as a viscous grease like emulsion.

EXAMPLE 2

In Table 1, all of the emulsions contained 5% by weight of the additive package from example 1, 1% by weight of a olefin sulfide extreme pressure agent and 2% by weight of the surfactant package of example 1. Three types of emulsions were made by the same method (as in example 1) but with different mixtures of water and alcohols. The ASTM D217 (penetration) test was used to determine the consistency of the products. The unit of measurement for this test is $1/10^{th}$ mm. Item 1 was prepared with the least amount of water, 32% wt, and had the highest penetration result of Po=355 which correlates to a NLGI "grade 0" grease. When propylene glycol (PRG) replaced the ETG (ethylene glycol) and with an increase in water to 65% wt. The emulsion became stiffer as seen by the penetration result with Po=309 was measured (item 2.) For item 3 the ethylene glycol was changed to glycerol while the water content remained at 65% wt, yielding an emulsion. This emulsion had a penetration Po=262 which corresponds to a "Grade 2" grease, the most commonly used grease in the industry. Item 4 and 5 showed the influence that increased levels of water have on the emulsion's penetration result. The emulsion product became softer in these examples with additional water as can be seen with penetration results of Po=327 and 326, respectively.

TABLE 1

Penetration Results Resulting from Polar Changes

| Item<br>Additives | 1<br>% | 2<br>% | 3<br>% | 4<br>% | 5<br>% |
|---|---|---|---|---|---|
| Water | 32 | 65 | 65 | 70 | 75 |
| Ethylene glycol | 48 | | | | |
| Propylene glycol | | 15 | | | |
| Glycerol | | | 15 | 10 | 5 |
| Citgo 150 bright stock | 10.4 | 9.5 | 9.5 | 10.4 | 10.4 |
| 2,000 Mn Polyisobutylene | 1.6 | 2.5 | 2.5 | 1.6 | 1.6 |
| Tests | | | | | |
| D217 Penetration ($1/10^{th}$ mm) | 355 | /309 | 262 | 327 | 326 |

TABLE 1-continued

Penetration Results Resulting from Polar Changes

| Item<br>Additives | 1<br>% | 2<br>% | 3<br>% | 4<br>% | 5<br>% |
|---|---|---|---|---|---|
| D2509 Timken (lbs) | 25# | not run | 30# | 30# | 35# |
| D2266 Four Ball Wear (mm) | 0.57 | 0.57 | 0.54 | 0.63 | 0.48 |
| D2596 Four Ball (kg) | 160 | 126 | 126 | 126 | 126 |

A lubricant must meet certain test requirements in order for it to be considered acceptable for use in an application. Commonly available greases will have Timken (ASTM D2509) results between 20–40 pounds, a 4-ball wear (ASTM D2266) of <0.60 mm, a 4-ball EP (ASTM D2596) that is >250 kg and a pass in the ASTM D1743B rust test.

The performance results for these emulsions are shown in Table 1. Item 1 had a result in the ASTM D2509 Timken test of 25 lbs. and wear result in the ASTM D2266 Four-Ball Wear test result of 0.57 mm. Likewise, items 3 and 4 gave Timken results of 30 lbs. when glycerol replaced ethylene glycol, and the wear results still remained approximately the same at 0.57 and 0.63 mm. Item 5 had the highest amount of water with the least amount of glycerol and a good Timken test result of 35 lbs and wear scar of 0.48 mm in the fourball wear test. The ASTM D2596 four-ball EP test result was 160 kg weld for item 1 with the remaining items giving results of 126 kg. These favorable test results in traditional grease tests are surprising in view of these novel emulsified lubricant compositions containing high levels of water.

EXAMPLE 3

The results in Table 2 were made with Citgo 150 bright stock (items 6 and 7) and contained 5% by weight of the additive package from example 1, 1% by weight of a olefin sulfide extreme pressure agent and 2% by weight of the surfactant package of example 1.

TABLE 2

Effects on the Penetration Due to Oils Types

| Item | 6 | 7 |
|---|---|---|
| delete | delete | delete |
| Water | 67.5 | 57.5 |
| Citgo 150 bright stock | 9.5 | 9.5 |
| delete | delete | delete |
| Propylene Glycol | 15 | 25 |
| 2000 Mn polyisobutylene | 2 | 2 |
| Tests | | |
| D217 (1/10$^{th}$ mm) | 287 | 347 |
| D2509 (load) | 35# | 40# |
| D2596 (weld) | 126 kg | 126 kg |

The Timken results for the stable emulsions, items 6 and 7 were very good with 35–40 lb Timken OK load results.

EXAMPLE 4

About 69 parts of water, about 12 parts of a lithium 12-hydroxystearate thickened grease made in about a 750 SUS naphthenic base oil and having a ASTM D-217 Cone Penetration of 254, and about 5 parts of sorbitan monooleate, about 8 parts of soybean oil, about 4 parts of additives of Example 1, an overbased calcium sulfonate, and about 2 parts olefin sulfide are stirred using a Model 89 dispersator rated at one horsepower and manufactured by Premier Mill Corporation for about 5 minutes. The mixture was transferred to the bowl of a Hobart mixer fitted with a wisk. The mixture was processed for about 5 additional minutes in a Hobart mixer until a smooth and stiff product formed. The product obtained gave an unworked ASTM D217 cone penetration result of 280 and an ASTM D2266 four ball wear result of 0.64 mm. The material gave a pass result in the ASTM D1743B demonstrating good rust performance as an emulsified lubricant containing high levels of water.

EXAMPLE 5

About 70 parts of water, about 4 parts of a 42% aqueous solution of $NaH_2PO_4$, about 10 parts of a lithium 12-hydroxystearate thickened grease made in a 750 SUS naphthenic base oil and having a ASTM D-217 Cone Penetration of 254, and about 5 parts of sorbitan monooleate, about 5 parts of soybean oil, about 5 parts of additives from Example 1, a sulfur-phosphorous-containing additive package are stirred using a paint mixer for 5 minutes. The mixture was transferred to the bowl of a Hobart mixer fitted a wisk. The mixture was processed for about 5 additional minutes in a Hobart mixer until a smooth and stiff product formed. The product obtained gave an unworked ASTM D-217 cone penetration result of 299 and an ASTM D-2266 four ball wear result of 0.90 mm. The material gave a result of 315 kg in the ASTM D-2596 four ball weld test. This example demonstrates the use of water soluble additives, like $NaH_2PO_4$ improve the performance of the composition that would otherwise be insoluble in traditional oil-based lubricants.

EXAMPLE 6

About 66.5 parts of water, about 20 parts of a lithium 12-hydroxystearate thickened grease made in a 750 SUS naphthenic base oil and having a ASTM D-217 Cone Penetration of 254, about 5 parts of sorbitan monooleate, about 2 parts of corn starch, about 5 parts of an overbased calcium sulfonate, about 2 parts of an alkyl sulfide, and about 0.5 parts of a mixture of mono and dialkyl substituted phosphoric acids salted with an alkyamine are stirred using a dispersator for 5 minutes. The mixture was transferred to the bowl of a Hobart mixer fitted with a wisk. The mixture was processed for about 5 additional minutes until a smooth and stiff product formed. The product obtained gave an unworked ASTM D-217 cone penetration result of 316 and an ASTM D-2266 four ball wear result of 0.57 mm.

EXAMPLE 7

About 0.25 parts of a water-thickening product available from RT Vanderbilt known as Veegum-D and about 0.25 parts of $Na_2HPO_4$ are dissolved in 68.5 parts of water. To this solution is added 15 parts of a lithium 12-hydroxystearate thickened grease made in a 750 SUS naphthenic base oil and having a ASTM D-217 Cone Penetration of 254, about 5 parts of sorbitan monooleate, about 5 parts of an overbased calcium sulfonate, and about 0.5 parts of a mixture of mono and dialkyl substituted phosphoric acids salted with an alkyamine. The mixture is stirred using a dispersator mixer for 5 minutes. The mixture is transferred to the bowl of a Hobart mixer fitted a wisk and processed for an additional 5 minutes in until a smooth and stiff product formed. The product obtained gave an unworked ASTM D-217 cone penetration result of 308 and an ASTM D-2266 four ball wear result of 0.60 mm.

In the above description and examples of invention those skilled in that will perceive improvements, changes and modifications in the invention. Such improvements, changes and modifications within the skill of the art are intended to be covered by the following claims.

What is claimed is:

1. A process to produce an emulsified composition comprising

A. mixing the following components (a) a major amount of water, (b) a minor amount of oil of lubricating viscosity, (c) at least one emulsifier, (d) optionally, one or more water soluble additives, (e) one or more oil soluble additives, (f) optionally, one or more alcohols, and (g) one or more thickeners, and (h) combination thereof;

B. with sufficient shear to form a water in oil emulsion of a lubricant.

2. The process of claim 1 wherein the process is selected from the group comprising a batch, semi-batch, continuous or a combination thereof to produce an emulsified lubricant with a desired particle size and uniform dispersion of water in oil having a mean particle droplet size in the range of about 0.01 micron to about 20 microns; and wherein the temperature is in the range of ambient temperature to about 200° C., and the pressure is in the range of about atmosphere pressure to about 20,000/psi.

3. An emulsified composition comprising a major amount of water in the range of about 99% to about 5% by weight of the emulsified composition, a minor amount of an oil of lubricating viscosity in the range of about 1% to about 95% by weight of the emulsified composition and a minor but effective amount of at least one or more thickeners and one emulsifier to emulsify the aqueous and organic phase resulting in a water in oil emulsified grease.

4. The composition of claim 3 further comprises at least one of water soluble additives, alcohols, thickeners, solid additives and combinations thereof.

5. The composition of claim 3 having a viscosity in the range of about 200 to about greater than 200,000 cPs measured on a Brookfield Viscometer with a No. 7 spindle at 20 rpm at 25° C.

6. The composition of claim 3 wherein the oil comprises natural oils, synthetic oils, alkylene oxide polymers, esters of dicarboxylic acids, unrefined oils, refined oils, re-refined oils, waxes and combinations thereof.

7. The composition of claim 4 wherein the water soluble additives are selected from the group comprising at least one of alcohols; extreme pressure anti-wear additives; water soluble salts, selected from the group comprising dihydrogen butyl phosphate, water soluble dithiophosphate salts and combinations thereof; water soluble inorganic salts selected from the group comprising xanthates, dithiocarbonates, trithiocarbonates, sulfates, sulfites, sulfides and combinations thereof; water soluble phosphate esters, phosphites, phosphonates, dithiophosphate esters; water soluble rust inhibitors selected from the group comprising morpholine and alkanolamines, phosphorous and phosphoric acid derivatives including mono and diesters and amine or metallic salts of phosphoric and phosphorous acid, thickeners; and combinations thereof; and wherein the water soluble additives are present in the range of about 0% to about 50% by weight of emulsified composition.

8. The composition of claim 3 wherein the oil soluble additives are selected from the group consisting of extreme pressure anti-wear additives, metal deactivators, dispersants, antifoams, corrosion rust inhibitors, antioxidants, detergents, polymers, functionalized polymers and combinations thereof, wherein the oil soluble additives are present in the range of greater than 0% to about 75% by weight of the emulsified composition.

9. The composition of claim 8 wherein the antioxidants comprised of phenate sulfides, phosphosulfurized terpenes, sulfurized esters, aromatic amines, hindered phenols and combinations thereof and wherein the antioxidants are present in the range of about 0% to about 10% by weight of the emulsified composition.

10. The composition of claim 8 wherein the metal deactivators comprise benzotriazole, benzimidazole, 2-alkyldithiobenzimidazoles, 2-alkyldithiobenzothiazoles, 2-(N,N-dialkyldithiocarbamoyl)benzothiazoles, 2,5-bis(alkyldithio)-1,3,4-thiadiazoles, 2,5-bis(N,N-dialkyldithiocarbamoyl)-1,3,4-thiadiazoles and combinations thereof and wherein the metal deactivators are be present in the range of 0% to about 5% by weight of the emulsified composition.

11. The composition of claim 8 wherein the oil soluble detergents comprise overbased materials prepared by reacting an acidic material with a mixture comprising an acidic organic compound, a reaction medium comprising at least one inert, organic solvent for the acidic organic material, a stoichiometric excess of a metal base, and a promoter and wherein the detergent is present in the range of about 0% to about 8% by weight of the emulsified composition.

12. The composition of claim 8 wherein the antifoams comprise organic silicones, dimethyl silicone and combinations thereof and where the antifoams are present in the range of about 0% to about 2% by weight of the emulsified composition.

13. The composition of claim 8 wherein the antirust compounds comprise alkyl substituted aliphatic dicarboylic acids, alkenyl acids, succinic acids, sulfonates relating to the metal detergent, sodium nitrite, calcium salts of oxidized paraffin wax, magnesium salts of oxidized paraffin wax, alkali metal salts, alkaline earth metal salts or amine salts of beef tallow fatty acids, alkenyl succinates or alkenyl succinic acid half esters, glycerol monoesters, nonylphenyl ethoxylate, lanolin fatty acid esters, calcium salts of lanolin fatty acids, and combinations thereof and wherein the antirust compound is present in the range of about 0% to about 10% by weight of the emulsified composition.

14. The composition of claim 3 wherein the emulsifier comprises a surfactant with a hydrophilic lipophilic balance less than or equal to HLB of 9; and wherein the emulsifier is present in the range of about 20% to about 0.25% by weight of the emulsified composition.

15. The composition of claim 3 wherein the emulsifier comprises hydroxysubstituted hydrocarbon amines including mono-, di-, and tri-alkanol amines wherein each alkanol group contains 2 to about 10 carbon atoms; hydrocarbyl amines including mono-, di-, and tri-hydrocarbon amines wherein each hydrocarbon group has 1 to about 20 carbon atoms; polyols of 3 to 8 hydroxyls including those having 3 to 8 hydroxyl groups and 3 to 12 aliphatic carbon atoms and analogous materials made by treating such polyols with alkylene oxides of 2 to 8 carbon atoms; alkylene glycols including those wherein the alkylene group has 2 to 4 carbon atoms; polyalkylene glycols including those wherein each alkylene group is of 2 to 4 carbon atoms and the polyalkylene glycol has molecular weights ranging from 50 to about 1500; sulfonated materials such as sulfonated hydrocarbon and amine-neutralized salts thereof, sulfonamidcarboxylic acids and neutralized derivatives thereof and combinations thereof.

16. The composition of claim 3 wherein the emulsifier comprises (polybutenyl) dihydro-2,5-furandione with stearic acid and polyethylenepolyamines, (polyisobutenyl) dihydro-2,5-furandione, cyclic diamines, ethylenamines, pentaerythritol, 4-polybutenyl(C=20–2000)-2-aminophenol, maleinated polyisobutenyl succinic acid amine salts, polyolefin aminoester/salt, polyisobutenylsuccinic anhydride product with diethylethanolamine, polyisobutenylsuccinic anhydride, product with polyethyleneamines and boric acid, polyolefin amide alkeneamine, polyolefin aminoester , polyisobutenylsuccinic anhydride, product with polyethylenepolyamines and carbon disulfide, (polyisobutenyl) dihydro-2,5-furandione esters with pentaerythritol, (polyisobutenyl) dihydro-2,5-furandione pentaerythritol and polyethylenepolyamines, polyisobutenylsuccinic anhydride product with diethylethanolamine, polyisobutenylsuccinic anhydride, product with polyethylenepolyamines pibsa amines, polyisobutenyl glyoxylate amines, sorbitan mono oleate, sorbitan mono isosterate and sorbitan sesquioleate, and mixtures thereof.

17. The composition of claim 3 wherein the emulsifier comprises di- and tri-ethanol amine, propanol amine, polypropylene glycols, in liquid sugar alcohols, alkali and alkaline earth metal, dodecylbenzene sulfonates, alkali metal laurlsulfonates, alkylaryl sulfonate lignosulfonate salt, starches, and combinations thereof.

18. The composition of claim 4 wherein the alcohol comprises polyol, ethylene glycol, propylene glycol, methanol, ethanol, glycerols and combinations thereof and wherein the alcohol is present in the range of about 0% to about 30% by weight of the emulsified composition.

19. The composition of claim 3 used as an emulsified grease.

* * * * *